US006005459A

United States Patent [19]

Hoffman

[11] Patent Number: 6,005,459

[45] Date of Patent: Dec. 21, 1999

[54] SWITCHING DEVICE

[75] Inventor: Jerzy Hoffman, Las Vegas, Nev.

[73] Assignee: K & L Microwave Incorporated, Salisbury, Md.

[21] Appl. No.: 08/841,323

[22] Filed: Apr. 30, 1997

Related U.S. Application Data

[63] Continuation-in-part of application No. 08/650,105, May 17, 1996, Pat. No. 5,815,057.

[51] Int. Cl.[6] ..... H01H 9/00

[52] U.S. Cl. ..... 335/177; 335/106; 335/126; 335/132; 335/137; 335/144; 335/179; 335/182; 335/192; 335/234; 335/270; 335/274; 335/279

[58] Field of Search ..... 335/81, 126, 127, 335/128, 131, 179, 229–234, 106, 121, 132, 136, 137, 144, 177, 180, 182, 192, 264, 270, 274, 279

[56] References Cited

U.S. PATENT DOCUMENTS

| | | | |
|---|---|---|---|
| 2,140,604 | 12/1938 | Snavely . | |
| 2,749,403 | 6/1956 | Horman et al. | 335/126 |
| 2,919,323 | 12/1959 | Drescher . | |
| 2,919,324 | 12/1959 | Schuessler | 335/126 |
| 3,248,499 | 4/1966 | Young . | |
| 3,728,654 | 4/1973 | Tada | 335/234 |
| 4,122,420 | 10/1978 | Brown | 335/80 |
| 4,127,835 | 11/1978 | Knutson | 335/266 |
| 4,150,348 | 4/1979 | Foltz | 335/4 |
| 4,191,937 | 3/1980 | Koehler et al. | 335/230 |
| 4,251,789 | 2/1981 | Russell et al. . | |
| 4,260,159 | 4/1981 | Hoffman | 273/138 A |
| 4,288,771 | 9/1981 | Ueda et al. . | |
| 4,298,847 | 11/1981 | Hoffman | 335/105 |
| 4,319,211 | 3/1982 | Ueda et al. . | |
| 4,392,398 | 7/1983 | Hoffman | 81/9.51 |
| 4,462,013 | 7/1984 | Ueda et al. . | |
| 4,560,966 | 12/1985 | Nagamoto et al. | 335/80 |
| 4,581,597 | 4/1986 | Walley | 335/179 |
| 4,633,201 | 12/1986 | Ruff | 333/106 |
| 4,646,043 | 2/1987 | Hoffman | 335/255 |
| 4,697,056 | 9/1987 | Hoffman | 335/255 |
| 4,749,967 | 6/1988 | Hoffman et al. | 333/105 |
| 4,795,994 | 1/1989 | Hoffman | 335/82 |
| 4,908,588 | 3/1990 | Hoffman et al. | 333/105 |
| 4,978,935 | 12/1990 | Hoffman et al. | 335/121 |
| 5,006,826 | 4/1991 | Knoben et al. . | |
| 5,047,740 | 9/1991 | Alman | 335/4 |
| 5,227,750 | 7/1993 | Connell et al. | 335/86 |
| 5,272,458 | 12/1993 | Hoffman et al. | 335/179 |
| 5,315,273 | 5/1994 | Blair et al. | 333/81 R |
| 5,434,549 | 7/1995 | Hirabayashi et al. | 335/229 |

*Primary Examiner*—Michael L. Gellner
*Assistant Examiner*—Raymond Barrera
*Attorney, Agent, or Firm*—Banner & Witcoff, Ltd

[57] ABSTRACT

A switching device providing highly-reliable, frictionless, adjustment-free operation is described. Comprised of a comparatively small number of moving parts, the various aspects of the invention offer compact, cost-effective, reliable alternatives to their complex electromagnetic and costly solid-state counterparts. The main parts of the invention rely upon the principles of magnetic attraction and repulsion for the switching of a plurality of electrical contacts contained within the switching device. The flexibility inherent in the design of the invention permits the switching device to be configured in a variety of aspects, including the failsafe and latching designs described herein.

18 Claims, 5 Drawing Sheets

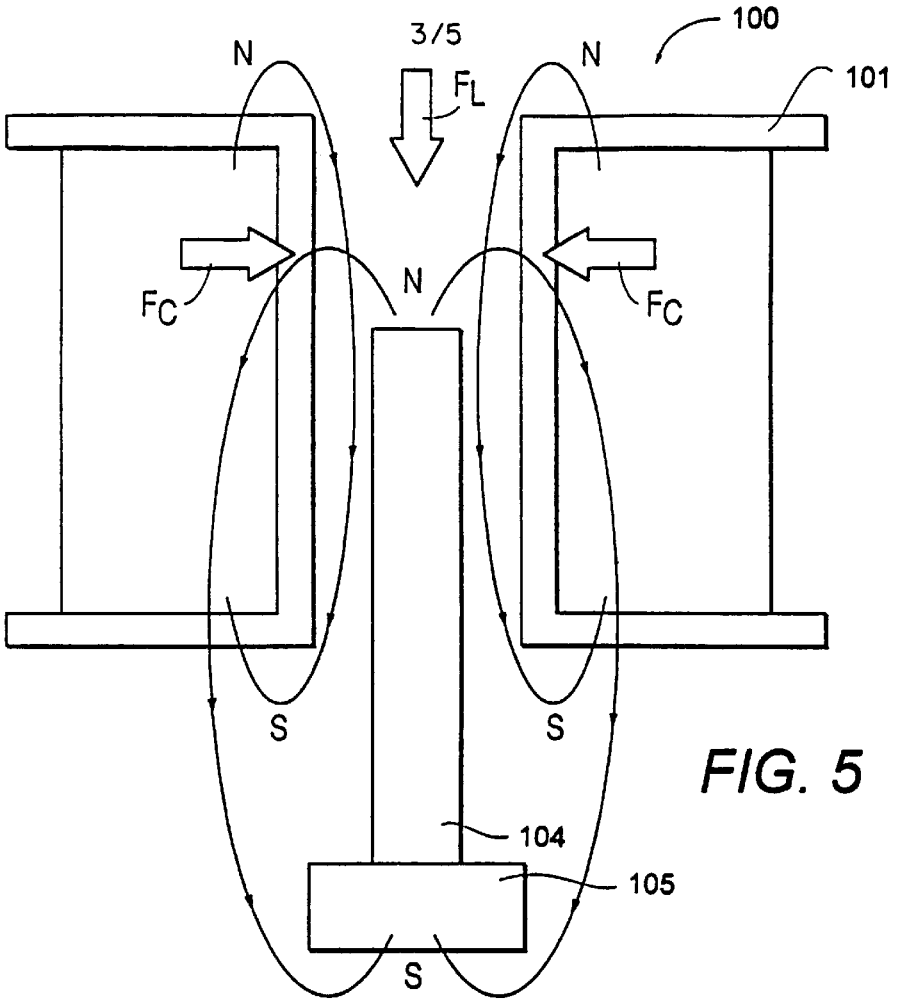
FIG. 5
FIG. 6
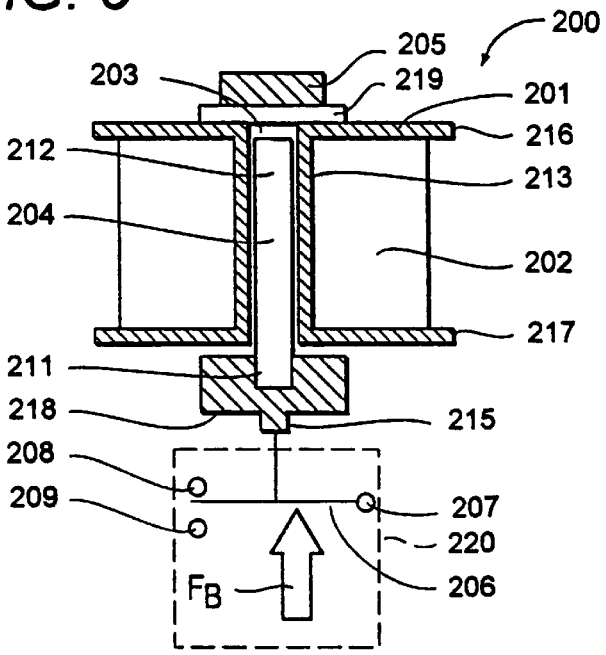

SWITCHING DEVICE

This application is a continuation-in-part application of U.S. patent application Ser. No. 08/650,105, filed May 17, 1996, now U.S. Pat. No. 5,815,057.

BACKGROUND OF THE INVENTION

This invention relates to magnetic switches and related devices used in electrical and electronic applications, and especially to highly-reliable magnetic devices used in RF or DC circuits.

Switching devices; e.g., switches and programmable attenuators, which use electromagnetic actuating structures, typically require a number of related mechanical assemblies, including plungers, armatures, springs and rockers, to switch signals among a plurality of electrical contacts. These mechanical parts are subject to friction and resulting wear, often requiring adjustment to maintain proper alignment and interaction among key parts. Because of these characteristics, switches and related devices which rely on numerous associated mechanical parts also tend to be less reliable than their all-electronic, or solid-state, counterparts. The large quantity of mechanical parts often associated with these drivers requires labor-intensive, and, hence, costly assembly operations. In addition, these same mechanical parts tend to limit life-cycle performance. Adverse susceptibilities to temperature extremes and vibration further restrict their application and usefulness. Solid-state switches, while addressing some of these concerns, lack the power-handling and isolation characteristics of electromagnetic switches which still make them the switch of choice, in spite of all the limitations outlined above, in many applications.

With the advent of the era of personal communications, the wireless communications market demands a compact, cost-effective, reliable switching device design capable of handling both DC and RF signals without compromise of key performance parameters. Similarly, military and space applications demand switches and related devices characterized by high performance as well as high reliability, in compact, reasonably-priced packages.

SUMMARY OF THE INVENTION

Objects of one or more aspects of the invention include overcoming the problems and limitations set out above to form a simple, compact, reliable, low cost switching device. The switching device of this invention is a unique assembly comprising three main parts: an electric coil wound about the circumference of a hollow spool, an activator, and a permanent magnet. These three parts are coaxially aligned such that the activator moves freely within the hollow core of the spool, and the permanent magnet, positioned outside of the spool, induces a magnetic field throughout the length of the activator. A magnetic field of the correct polarity, created by the flow of electrical current through the electric coil of the hollow spool, opposes the magnetic field induced in the activator, causing the activator to center itself within the hollow core of the spool, and to move within the hollow core in response to the opposing magnetic force created by the energized coil. The principles just described, and involving these three parts, form the basis for all aspects of the present invention described in detail in the paragraphs which follow.

In one aspect of the invention, the switching device is defined by the placement of the permanent magnet in contact with the activator, and adjacent to the contact element.

In another aspect of the invention, the same switching device is modified for use in switches and related devices which operate in a fail-safe mode, by placement of the permanent magnet at an end of the spool opposite to the contact element.

In still another aspect of the invention, the identical switching device is further modified for use in switches and related devices which operate in a latching mode, by combining the features of the previous two aspects.

It is an object of the present invention to provide a switching device for directing the current flow between an input terminal and an output terminal selected from the set of at least a first output terminal and a second output terminal. The switching device includes a spool with a spindle disposed on a central axis and a bore concentrically disposed through the spindle, an electrical coil wound around the spindle, an activator composed at least in part of a ferrous material, a contact element physically coupled to the activator, a biasing arrangement, and a permanent magnet. The application of electrical current through the electrical coil generates a magnetic field along said central axis. The activator includes first and second ends and is substantially disposed within the bore of the spool for movement along the central axis. The contact element directs the flow of electricity between the input terminal and a selected output terminal and is movable between a first position wherein the flow of electricity is directed between the input terminal and the first output terminal, and a second position wherein the flow of electricity is directed between the input terminal and the second output terminal. The biasing arrangement provides a force to bias the activator in a first direction and for biasing the contact element into its first position to direct the flow of electricity between the input terminal and the first output terminal. The permanent magnet is positioned immediately adjacent to one of the ends of the activator and induces a continuous magnetic field through the length of the activator along the central axis. The biasing arrangement forces the contact element into its first position in the absence of an electrical current applied to the coil, and the application of electrical current to the coil generates a magnetic field which opposes the continuous magnetic field induced in the activator by the permanent magnet thereby driving the activator in a second direction opposite the first direction and moving the contact element into its second position.

These aspects and objects, by no means, exhaust the seemingly endless list of applications in which the present invention can be used, and for which it is intended. They are only representative in nature, and are not to be construed as limiting the present invention or its application in any way.

BRIEF DESCRIPTION OF THE DRAWINGS

FIG. 5 shows the magnetic fields present in the switching device in the energized state, as shown in FIG. 3;

FIG. 6 is a vertical cross-sectional view of a modified switching device;

DETAILED DESCRIPTION OF THE PREFERRED EMBODIMENTS

Figure 1:
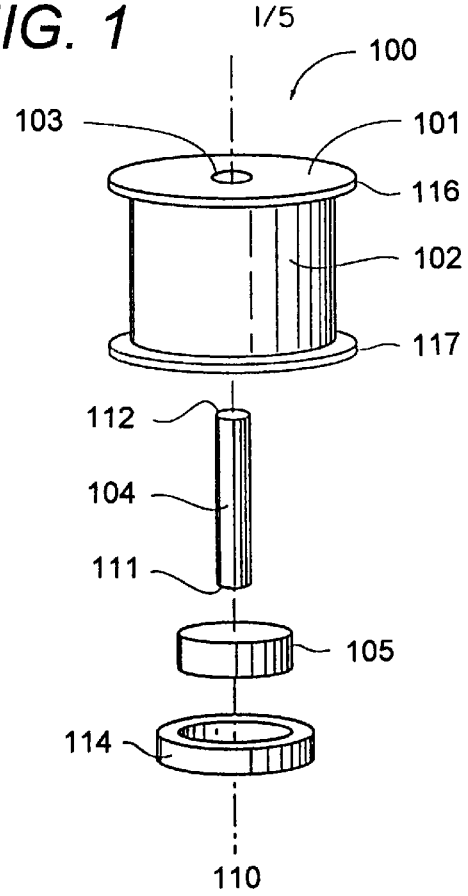
FIG. 1 is an exploded perspective view of the switching device of the present invention.

In the present invention, as shown in FIGS. 1–9, preferred switching devices for controlling the flow of electrical current between a plurality of terminals are designated generally by reference numerals 100, 200, 400 and 500. These switching devices can include switches, programmable attenuators, and other related devices. Unless otherwise indicated, the same reference numerals used to refer to elements of switch 100 will be indicated by similar reference numerals modified by having a different series of a hundred depending upon whether they refer to switch 200, switch 300, switch 400, or switch 500.

Figure 2:
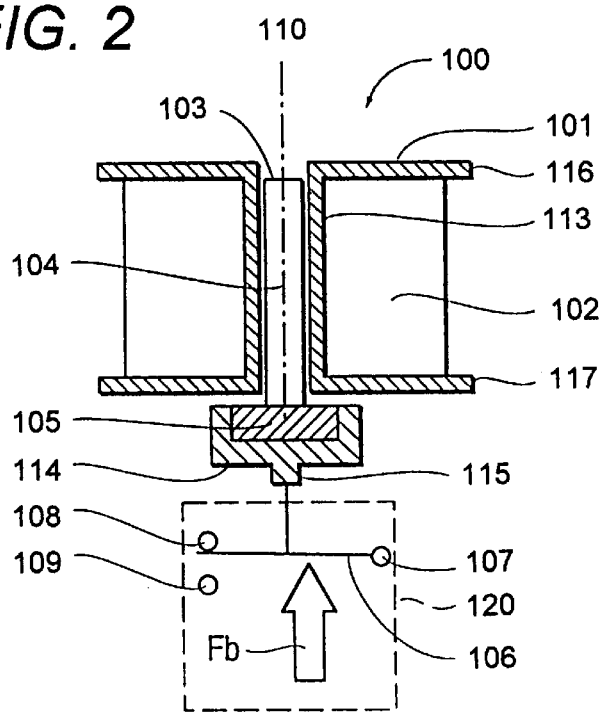
FIG. 2 is a vertical cross-sectional view of the switching device of FIG. 1 in a non-energized state.
Figure 3:
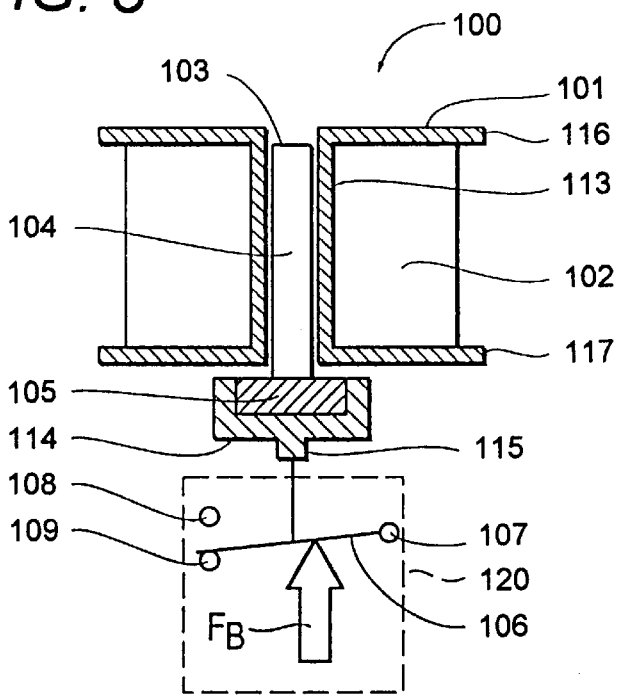
FIG. 3 is a vertical cross-sectional view of the switching device of FIG. 1 in an energized state.

As shown in FIGS. 1–5, in sum, switching device 100 preferably includes a spool 101 with a bore 103, an electrical coil 102 wound around spool 101, an activator 104, and a permanent magnet 105. As schematically shown in FIGS. 2 and 3, activator 104 is structurally coupled to a switching contact element 106 of a contact assembly 120. Contact element 106 is movable between at least first and second positions to electrically connect an input terminal 107 to either a first output terminal 108 or a second output terminal 109. As activator 104 and contact element 106 are structurally coupled, movement of activator 104 along an axis 110 centrally disposed within bore 103 moves contact element 106 between its first and second positions.

Activator 104 is moved along central axis 110 by a driving system which includes activator 104, permanent magnet 105, coil 102, and a biasing system. Activator 104 is preferably comprised entirely of a ferrous material such that a continuous magnetic field is induced along its length when a permanent magnet is positioned immediately adjacent to its lower end 111 or its upper end 112.

Figure 8:
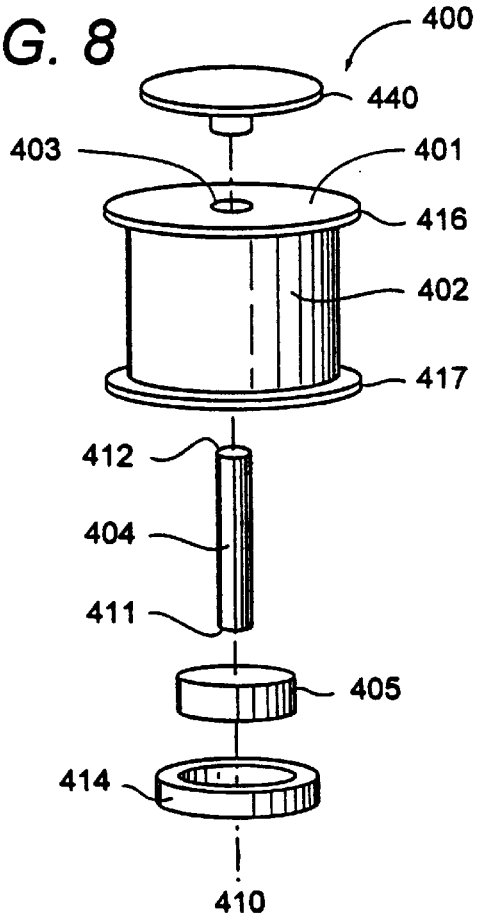
FIG. 8 is a vertical cross section of a third modified switching device.
Figure 9:
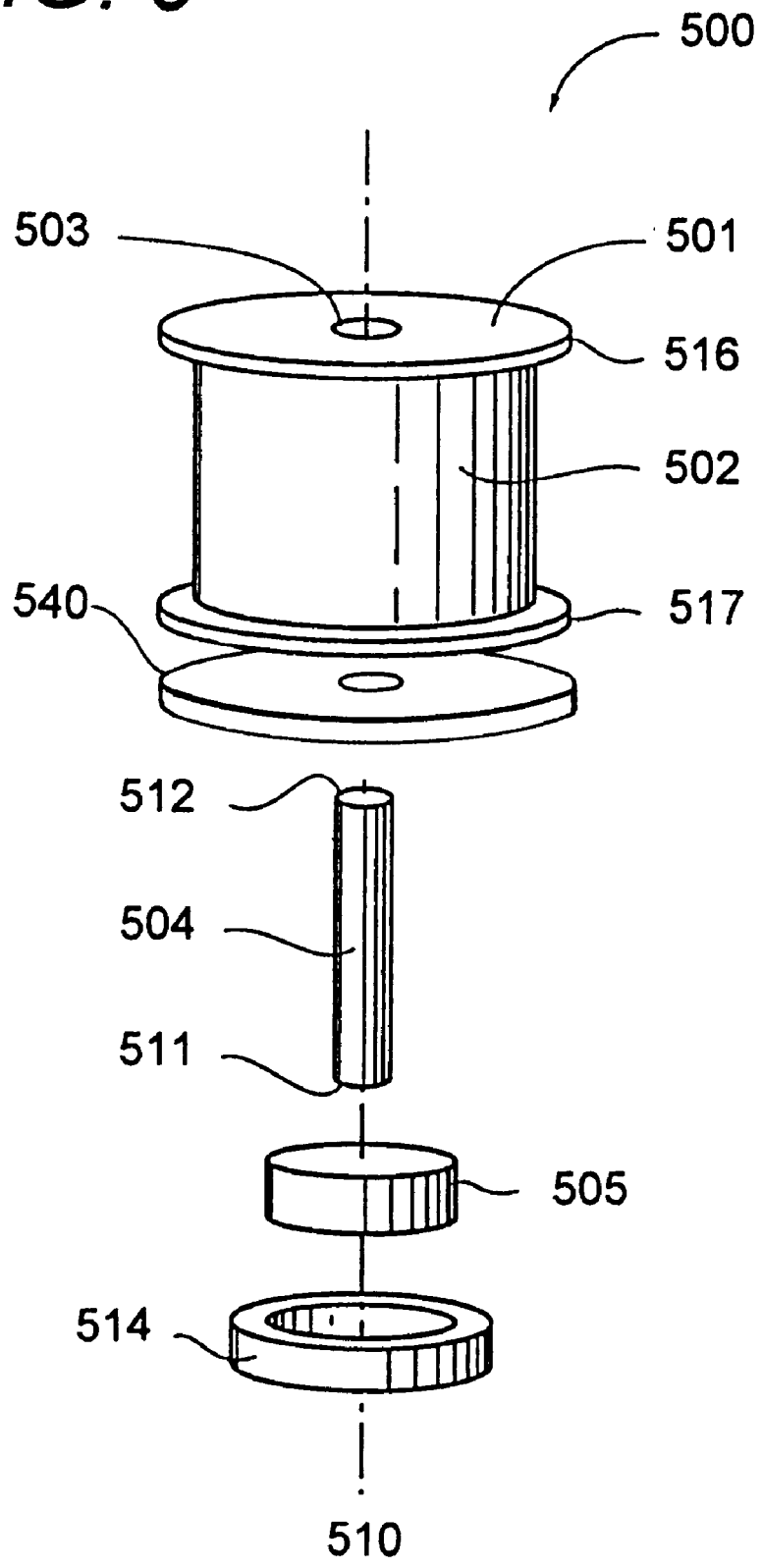
FIG. 9 is a vertical cross section of a fourth modified switching device.

In one arrangement, the spool 101 is made from a non-ferrous material, preferably from an inexpensive, lightweight plastic. However, the switch 100 may include ferrous material in or near the spool 101, as shown in FIGS. 8 and 9 and described later herein. Spool 101 also includes upper and lower flanges 116 and 117. A bore 103 is formed through the center of the spindle 113 of the spool 101, and is sized to permit the activator 104 to move freely through its length. Permanent magnet 105 is sized to prevent its entry into the bore 103 of the spool 101. While FIG. 1 depicts actuator 104 and bore 103 as having corresponding cylindrical shapes, this invention anticipates these parts having polygonal cross-sections ranging from triangular to circular, and every geometric possibility therebetween.

FIG. 2 presents, in a cross-sectional view, the switch 100 in a non-energized, or rest state. In this state, activator 104 is largely contained within the bore 103 of the spool 101 and contact element 106 is in a first position electrically coupling input terminal 107 to the first output terminal 108. The permanent magnet 105 is joined by magnetic attraction to the activator 104, and is positioned adjacent to or touching the lower surface of the spool 101. When electrical current of the correct polarity is applied to the electrical coil 102, a magnetic field is created which opposes the field induced in the activator 104 by the permanent magnet 105. As a direct result, this magnetic field simultaneously centers the activator 104 within the bore 103, and drives the activator 104 in the direction of the permanent magnet 105, and, therefore, out of the spool 101, as shown in FIG. 3. This moves the contact element 106 from its first position to its second position where it electrically couples the input terminal 107 to the second output terminal 109. One advantageous feature of this invention lies in the fact that the activator 104 exhibits frictionless movement within the bore 103. This is due to the influence of opposing magnetic fields generated by the permanent magnet 105 and the electrical coil 102 when energized by current from an electrical source and by an equal collapse of opposing magnetic fields when the current is removed.

As shown in FIGS. 2 and 3, a magnet holder 114 is permanently attached to the permanent magnet 105 of the switching device, and includes an attachment structure 115 incorporated therein. In the preferred embodiment, the attachment structure 115 projects in a direction opposite from and coaxially aligned with the activator 104. This attachment structure 115 engages the contact element 106 in such a way as to facilitate the making and breaking of electrical contacts with the movement of the activator 104 within the bore 103 in response to electrical current of the correct polarity supplied to the electrical coil 102.

In switch 100, a biasing force $F_b$ provides resistance which biases the activator 104, permanent magnet 105, magnet holder 114, and contact element 106, into the desired first position shown in FIG. 2 when no electrical current is applied to the coil 102 and switch 100 is in its de-energized state. Thus, switch 100 behaves as a fail-safe switch, always returning to the position shown in FIG. 2 in the absence of power. This biasing force $F_b$ can be accomplished by the cantilevered mounting of contact element 106 in combination with spring-like properties inherently associated with the material of contact element 106. In the alternative, biasing force $F_b$ can be created by a secondary spring applying a force to the contact element 106 or to magnet holder 114. Additionally, the biasing force can be created by other arrangements as shown in the switches of FIGS. 6–9.

In addition, a stopping arrangement is provided which limits the outward movement of the activator 104 from within the bore 103 in response to an opposing magnetic field generated by the electrical coil 102. The stopping arrangement prevents the activator 104 from moving fully outside and beyond the limits of the bore 103. This stopping arrangement can be provided by the mounting and physical limitations of contact element 106 or may be provided by a secondary physical structure physically stopping the movement of contact element 106, the magnet holder 114, or magnet 105.

This invention anticipates its application to a broad family of contact elements to make a nearly endless line of devices. Therefore, the attachment structure 115 may be incorporated in, or project in other directions from, the magnet holder 114 or take other forms to accomplish its intended purpose, and the contact element 106 and magnet holder 114 may similarly be designed and manufactured in any number of different ways. An additional advantage inherent in the linkage of the activator 104 of the switching device through the attachment structure 115 to the contact element 106 is the lack of adjustment required to properly space contacts and mechanical linkage of the contact element 106 to the activator 104 to ensure proper and reliable operation over the life of the switch or related device. A switching device design using the invention disclosed herein is virtually adjustment-free throughout its service life.

Figure 4:
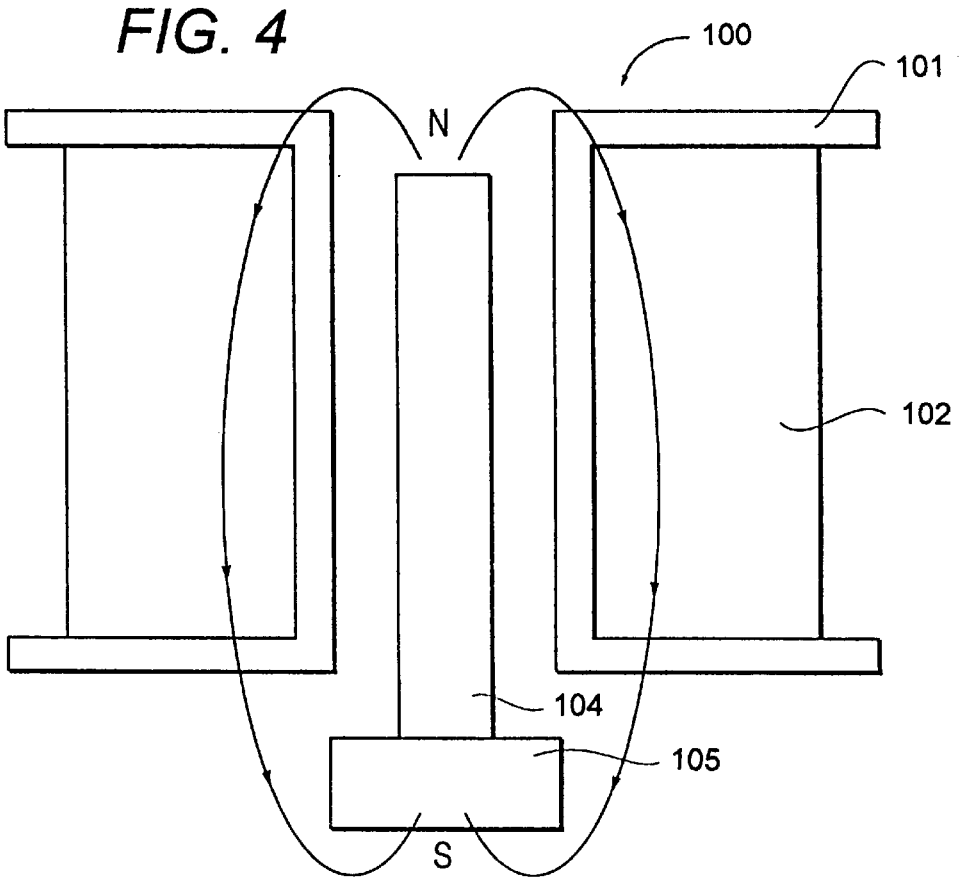
FIG. 4 shows the magnetic fields present in the switching device in the non-energized state, as shown in FIG. 2.

FIGS. 4 and 5 show the magnetic fields present in the switching device in the non-energized and energized states shown in FIGS. 2 and 3, respectively. As depicted in FIG. 4, the magnetic field of the permanent magnet 105, and the magnetic field of activator 104 induced by the permanent magnet 105, are magnetically coupled to form a single, common magnetic field encompassing both the activator 104 and the permanent magnet 105. As previously described, the biasing force $F_b$ is sufficient to hold the activator 104 in the rest position substantially within the bore 103 of spool 101, as shown in FIGS. 2 and 4. As previously described, in this position, contact element 106 electrically couples input terminal 107 with first output terminal 108.

When a magnetic field of identical polarity is created by current flow through the electrical coil 102, as shown in FIG. 5, a repulsion force is created between the like poles of (I) the activator 104 and magnet 105 and (ii) the magnetic field created by the application of current to coil 102. This repulsion force accomplishes two functions. First, the repulsion force has circumferential components $F_c$ which simultaneously center the activator 104 within bore 103. This creates frictionless movement and acts as a linear guide as the activator 104 moves from its first position to its second position. Second, this repulsion force has a linear component $F_1$ which propels the activator 104 in a direction toward the permanent magnet 105. This force $F_1$ is greater than the biasing force $F_b$ and causes an additional section of activator 104 to move out of bore 103. The activator 104 and permanent magnet 105 are prevented from moving entirely out of bore 103 by the stopping arrangement as previously described, e.g., the physical limitations of the contact element 106 or a physical stop. As a result of this movement by activator 104, electrical contact of the input terminal 107 is broken with first output terminal 108, and is made with second output terminal 109.

When electrical current is removed from the electrical coil 102, the corresponding magnetic field about the electrical coil 102 collapses. Excluding gravitational forces, the only remaining force applied to actuator 104 is biasing force $F_b$ applied to contact element 106 which is sufficient to return the activator 104, permanent magnet 105, and electrical terminal connections within contact element 106 to their first positions shown in FIG. 2, and maintain them in this state while switch 100 is de-energized or at rest. Initial testing results indicates that frictionless movement may also be achieved in this direction due to the even collapse of the magnetic field around the activator 104. Note that the forces on actuator 104 due to gravity are sufficiently lower than biasing force $F_b$. This permits switch 100 to function effectively in any mounting orientation.

FIG. 6 presents a cross-sectional view of a modified switching device 200 for use in switches and related devices that operate in a fail-safe mode. As previously described, the fail-safe mode always moves the actuator and its switch contact element or elements to a predetermined position in the non-energized state. To accomplish this reliability, the activator 204 is joined at its lower end 211 to an activator holder 218, and permanent magnet 205 is positioned adjacent to the upper flange 216 of the spool 201. The poles of permanent magnet 205 are oriented such that magnet 205 attracts the upper end 212 of activator 204. Thus, when switch 200 is not energized, there are two separate forces urging activator 204 to its first position. These forces are (I) an upward magnetic attraction biasing force caused by magnet 205 attracting activator 204 and (ii) an upward biasing force $F_b$ caused by a biasing arrangement as previously described. It is noted that if the magnetic biasing force between magnet 205 and activator 204 is sufficient to draw activator 204 from its second position to its first position, upon the removal of current to coil 202, then it is possible to remove the arrangement providing the biasing force $F_b$.

Activator holder 218 is preferably made from a non-ferrous material and includes an attachment structure 215 identical in function to the attachment structure 115 in FIGS. 2 and 3. Note that switch 200 does not include a permanent magnet coupled to activator 204 as permanent magnet 205 creates the desired magnet field around activator 204.

An optional mounting flange 219 of ferrous material may be interposed between the permanent magnet 205 and the upper flange 216 and permanently affixed to the upper flange 216. This facilitates the mounting of the permanent magnet 205, which is also joined by magnetic attraction to the mounting flange 219 in coaxial alignment with the activator 204.

In operation, assuming that switch 200 is in its non-energized state and input terminal 207 is electrically coupled to first output terminal 208 by contact element 206 of contact assembly 220 as shown in FIG. 6, the application of electrical current to coil 202 creates a magnetic field. As described with respect to switch 100, this magnetic field creates a repulsion force which simultaneously centers the activator 204 within bore 203 providing frictionless movement, and propels the activator 204 downward here in a direction away from the permanent magnet 205. As a result of this movement by activator 204, electrical contact of the input terminal 207 is broken with first output terminal 208, and is made with second output terminal 209. A stopping arrangement, as described with respect to switch 100, is used to stop the movement of activator 204 when switch 200 is energized.

When current is removed from the electrical coil 202, the activator 204 is drawn back into the rest position shown in FIG. 6 by the positive magnetic force exerted upon it by the permanent magnet 205 through the mounting flange 219, and the biasing force $F_b$ provided by the contact element 206 or other arrangement. The fail-safe mode is thus assured by the placement of the permanent magnet 205 and mounting flange 219 at the end of the activator 204 opposite the contact element 206.

Figure 7:
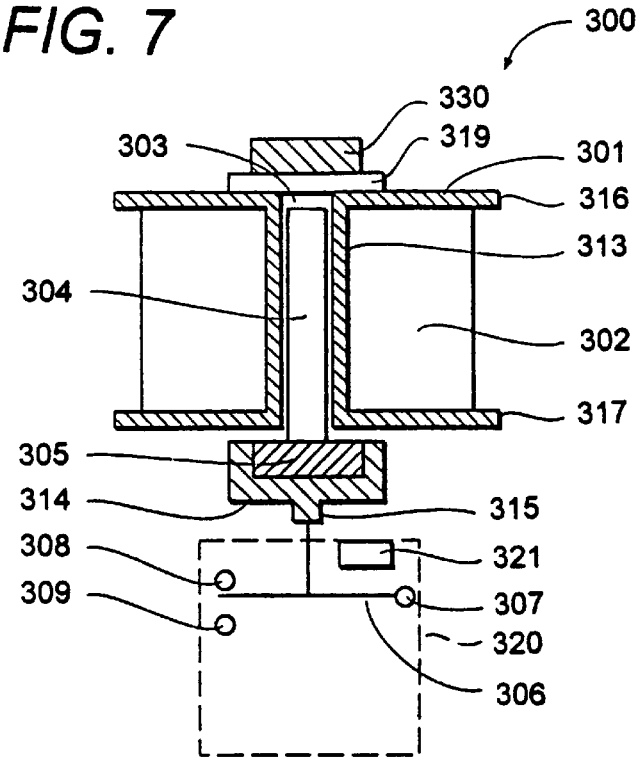
FIG. 7 is a vertical cross-sectional view of a second modified switching device.

FIG. 7 portrays a cross-sectional view of a modified switching device 300 for use in switches and related devices that operate in a latching mode. In the latching device, the activator 304 and the contact element 306 will remain in either of its positions in the absence of electrical current applied to coil 302. Thus, activator 304 can be in either position in a non-energized state.

The activator 304 and contact element 306 are driven between their two positions by the application of electrical current to coil 302 in a specific direction. Any appropriately sized logic switching device, which is not shown but is well known in the art, reverses the polarity of the current applied to coil 302 between applications.

Switch 300 has a magnetic latching biasing system which biases the actuator 304 to remain in either of its positions in the absence of electrical current applied to coil 302. A preferred biasing system is depicted in FIG. 7. This system includes mounting flange 319 and permanent magnet 330 similar to those shown in switch 200 of FIG. 6 in structure and function. Switch 300 further includes magnet 305 magnetically coupled to activator 304 similar in structure and function to the arrangement of like parts shown in switch 100 of FIGS. 1–5. Thus, magnet 330 magnetically attracts and biases magnet 305 and activator 304 into the first position wherein contact element 306 couples input terminal 307 with first output terminal 308, as shown in FIG. 7.

Additionally, sufficient ferrous mass 321 is included in or adjacent contact assembly 320 to magnetically attract and bias magnet 305 and activator 304 into the second position wherein contact element 306 couples input terminal 307 with second output terminal 309.

The spacing and sizing of the elements, the strength of magnets 330 and 305, and other variables of the two magnetic biasing and latching arrangements are designed such that (I) the magnetic attraction force between magnet 330 and activator 304 is larger than the magnetic attraction force between magnet 305 and ferrous mass 321 when the activator 304 is in the first position, i.e., when contact element 306 couples input terminal 307 with first output terminal 308, and (ii) the magnetic attraction force between magnet 305 and ferrous mass 321 is larger than the magnetic attraction force between magnet 330 and activator 304 when the activator 304 is in the second position, i.e., when contact element 306 couples input terminal 307 with second output terminal 309.

Moreover, as electrical current does not need to be applied to maintain activator 304 in either position, it is only required to apply electrical current to coil 302 for an amount of time necessary to generate the necessary magnetic field to move the activator 304. Thus, only a short burst of current may be necessary. Further, as in the previous switches 100 and 200, the application of electrical current to coil 302 not only moves the actuator 304, but does so in a frictionless manner.

Additionally, switch 300 does not require an additional or spring biasing arrangement as described with respect to a previous embodiment. However, such a biasing arrangement may be used to further provide a biasing force for activator 104 in either direction.

The activators 104, 204, and 304 of switches 100, 200, and 300 are believed to function having a length which is in the range between 25%–200% of the length of bore. However, in preferred arrangements, the activators would extend preferably between 50% and 100% of the way into the bore, and more preferably between 85% and 95%.

FIG. 8 shows an exploded view of another modified switching device 400. Switching device 400 has many similarities to previous switching devices shown herein, including coil 402, bore 403, actuator 404, and permanent magnet 405. However, there are some distinctions including that spool 401 is preferably made from a ferrous material. Permanent magnet 405 is preferably retained in a magnet holder 414, which is coupled to a contact assembly, not shown.

Switching device 400 is of the fail-safe type as previously described, and, in the absence of current applied to coil 402, actuator 404 is drawn upward toward a ferrous plate 440 due to the magnetic field induced along its length caused by magnet 405. As this biasing arrangement is sufficient to draw the actuator 404 upward, the contact assembly need not include any inherent biasing arrangement, i.e., it is springless. As with the other embodiments, any desired stopping arrangement can be used to limit the movement of actuator 404 along axis 410.

In operation, in the absence of power, actuator 404 is in an upper position with its upper end 412 adjacent ferrous plate 440. This is due to the magnetic field induced along actuator 404 caused by the magnet 405 attached to its lower end 411. The ferrous material of the spool 401 acts to center the actuator 404 within bore 403. When current is applied to coil 402, a magnetic field is created which moves actuator 404 downwardly to its lower position. Upon the removal of current to coil 402, the magnetic attraction between plate 440 and actuator 404 returns the actuator 404 to its upper position. The movement of actuator 404 in both directions along axis 410 is frictionless due to magnetic forces which center actuator within bore 403.

Additionally, plate 440 may be provided with a central extension to aid in coupling the plate 440 to the upper flange 416 of spool 401. The length of this extension may also be used as a design tool to regulate the spacing, and thus the magnetic force, between upper end 412 of actuator 404 and plate 440.

FIG. 9 shows yet another modified switching device 500. Switching device 500 is similar to the switching device 400 of FIG. 8 differing only in that a ferrous plate 540 is positioned adjacent lower flange 517 of spool 501 instead of adjacent the upper flange 516 of spool 501. Like the arrangement of FIG. 8, this creates a biasing device drawing magnet 505 and actuator 504 into an upper position except the magnetic attraction force is between magnet 505 and ferrous plate 540. In operation, switching device 500 operates the same as switching device 400 of FIG. 8.

It is recognized that switching devices 400 and 500 both have arrangements which couple the actuator 404 and 504 to a contact assembly not shown, such that the position of actuator controls the position of contact assembly.

It is recognized that with respect to all of the disclosed fail-safe switching devices, the contact assembly can be designed such that they are normally-open or normally-closed.

While particular embodiments of the invention have been shown and described, it is recognized that various modifications thereof will occur to those skilled in the art. Therefore, the scope of the herein-described invention shall be limited solely by the claims appended hereto.

I claim:

1. A switching device for directing the current flow between an input terminal and an output terminal selected from the set of at least a first output terminal and a second output terminal, said switching device comprising:

a spool, said spool having a spindle disposed on a central axis and a bore concentrically disposed through said spindle;

an electrical coil wound around said spindle, wherein the application of electrical current through said electrical coil generates a magnetic field along said central axis;

an activator composed at least in part of a ferrous material, said activator having first and second ends and being substantially disposed within the bore of said spool for movement along said central axis;

an input terminal and an output terminal selected from the set of at least a first output terminal and a second output terminal;

a contact element physically coupled to said activator, said contact element directing the flow of electricity between said input terminal and a selected output terminal, said contact element being movable between a first position wherein the flow of electricity is directed between said input terminal and said first output terminal, and a second position wherein the flow of electricity is directed between said input terminal and said second output terminal;

biasing means for providing a force to bias said activator in a first direction and for biasing said contact element into its first position to direct the flow of electricity between said input terminal and said first output terminal;

a first permanent magnet positioned on said central axis substantially outside of the bore and attached to said first end of said activator, said first permanent magnet having magnetic material intersecting the central axis, said first permanent magnet inducing a continuous magnetic field through the length of said activator along said central axis, wherein said first permanent magnet is joined by magnetic attraction to said first end of said actuator permitting relative movement therebetween in a direction perpendicular from said central axis;

a second permanent magnet positioned on said central axis substantially outside of the bore and immediately adjacent to said second end of said activator, said second permanent magnet having magnetic material intersecting the central axis, wherein said second permanent magnet is spaced a distance from said second end of said activator;

wherein the biasing means forces the contact element into its first position in the absence of an electrical current applied to said coil, and wherein the application of electrical current to said coil generates a magnetic field which opposes said continuous magnetic field induced in said activator by said first permanent magnet thereby driving said activator in a second direction opposite said first direction and moving the contact element into its second position.

2. The switching device of claim 1, wherein said second permanent magnet is attached to said spool.

3. The switching device of claim 1, wherein said biasing means is a first biasing means, said switching device further comprising a second biasing means, said second biasing means maintaining said contact element in its said second position in the absence of electrical current applied to said coil, said second biasing means includes a ferrous element and said first permanent magnet and generates a biasing force by the magnetic attraction between the first permanent magnet and the ferrous element.

4. The switching device of claim 1, wherein said biasing means includes said contact element and said biasing force is created by the positioning and memory of the contact element.

5. The switching device of claim 1, wherein the activator is made entirely of ferrous material.

6. The switching device of claim 1, wherein the first permanent magnet is larger than said bore preventing entry therein.

7. The switching device of claim 1, further comprising means for moving the activator along said central axis in a frictionless manner.

8. The switching device of claim 7, wherein the means for moving the activator along the central axis in a frictionless manner moves the activator along the central axis in a frictionless manner in both directions.

9. A switching device for directing the current flow between an input terminal and an output terminal selected from the set of at least a first output terminal and a second output terminal, said switching device comprising:

a spool, said spool having a spindle disposed on a central axis and a bore concentrically disposed through said spindle;

an electrical coil wound around said spindle, wherein the application of electrical current through said electrical coil generates a magnetic field along said central axis;

an activator composed at least in part of a ferrous material, said activator having first and second ends and being substantially disposed within the bore of said spool for movement along said central axis;

an input terminal and an output terminal selected from the set of at least a first output terminal and a second output terminal;

a contact element physically coupled to said activator, said contact element directing the flow of electricity between said input terminal and a selected output terminal, said contact element being movable between a first position wherein the flow of electricity is directed between said input terminal and said first output terminal, and a second position wherein the flow of electricity is directed between said input terminal and said second output terminal; biasing means for providing a force to bias said activator in a first direction and for biasing said contact element into its first position to direct the flow of electricity between said input terminal and said first output terminal;

a permanent magnet positioned on said central axis substantially outside of the bore and attached to said first end of said activator, said permanent magnet having magnetic material intersecting the central axis, said permanent magnet inducing a continuous magnetic field through the length of said activator along said central axis, wherein said permanent magnet is joined by magnetic attraction to said first end of said activator permitting relative movement therebetween in a direction perpendicular from said central axis;

wherein said permanent magnet is a first permanent magnet, said switching device further comprising a second permanent magnets, said second permanent magnet is attached to said spool adjacent to said second end of said activator;

wherein the biasing means forces the contact element into its first position in the absence of an electrical current applied to said coil, and wherein the application of electrical current to said coil generates a magnetic field which opposes said continuous magnetic field induced in said activator by said first permanent magnet thereby driving said activator in a second direction opposite said first direction and moving the contact element into its second position.

10. The switching device of claim 9, wherein the activator is made entirely of ferrous material.

11. The switching device of claim 9, wherein the first permanent magnet is larger than said bore preventing entry therein.

12. A switching device for directing the current flow between an input terminal and an output terminal selected from the set of at least a first output terminal and a second output terminal, said switching device comprising:

a spool, said spool having a spindle disposed on a central axis and a bore concentrically disposed through said spindle;

an electrical coil wound around said spindle, wherein the application of electrical current through said electrical coil generates a magnetic field along said central axis;

an activator composed at least in part of a ferrous material, said activator having first and second ends and being substantially disposed within the bore of said spool for movement along said central axis;

an input terminal and an output terminal selected from the set of at least a first output terminal and a second output terminal;

a contact element physically coupled to said activator, said contact element directing the flow of electricity between said input terminal and a selected output terminal, said contact element being movable between a first position wherein the flow of electricity is directed between said input terminal and said first output terminal, and a second position wherein the flow of electricity is directed between said input terminal and said second output terminal;

biasing means for providing a force to bias said activator in a first direction and for biasing said contact element into its first position to direct the flow of electricity between said input terminal and said first output terminal;

a first permanent magnet positioned on said central axis substantially outside of the bore and attached to said first end of said activator, said first permanent magnet having magnetic material intersecting the central axis, said first permanent magnet inducing a continuous magnetic field through the length of said activator permitting relative movement therebetween in a direction perpendicular from said central axis;

a second permanent magnet positioned on said central axis substantially outside of the bore and immediately adjacent to said second end of said activator, said second permanent magnet having magnet material intersecting the central axis, and said second permanent magnet is attached to said spool adjacent the second end of the activator;

wherein the biasing means forces the contact element into its first position in the absence of an electrical current applied to said coil, and wherein the application of electrical current to said coil generates a magnetic field which opposes said continuous magnetic field induced in said activator by said first permanent magnet thereby driving said activator in a second direction opposite said first direction and moving the contact element into its second position.

13. The switching device of claim 12, wherein the activator is made entirely of ferrous material.

14. The switching device of claim 12, wherein said first permanent magnet is joined by magnetic attraction to said first end of said activator permitting relative movement therebetween in a direction perpendicular from said central axis.

15. The switching device of claim 14, wherein said biasing means is a first biasing means, said switching device further comprising a second biasing means, said second biasing means maintaining said contact element in its said second position in the absence of electrical current applied to said coil, said second biasing means includes a ferrous element and said first permanent magnet and generates a biasing force by the magnetic attraction between the first permanent magnet and the ferrous element.

16. The switching device of claim 14, further comprising means for moving the activator along said central axis in a frictionless manner.

17. The switching device of claim 16, wherein the means for moving the activator along the central axis in a frictionless manner moves the activator along the central axis in a frictionless manner in both directions.

18. The switching device of claim 17, wherein the first permanent magnet is larger than said bore preventing entry therein.

* * * * *